United States Patent [19]

Kobayashi et al.

[11] Patent Number: 4,617,890

[45] Date of Patent: Oct. 21, 1986

[54] APPARATUS FOR CONTROLLING IDLING SPEED IN INTERNAL COMBUSTION ENGINE HAVING TWO BYPASS AIR PASSAGES

[75] Inventors: Nobuyuki Kobayashi; Toshimitsu Ito, both of Toyota, Japan

[73] Assignee: Toyota Jidosha Kabushiki Kaisha, Toyota, Japan

[21] Appl. No.: 749,089

[22] Filed: Jun. 26, 1985

[30] Foreign Application Priority Data

Jun. 26, 1984 [JP] Japan ..... 59-129976

[51] Int. Cl.[4] ..... F02D 41/16; F02M 23/06

[52] U.S. Cl. ..... 123/339; 123/585

[58] Field of Search ..... 123/339, 585

[56] References Cited

U.S. PATENT DOCUMENTS 4,462,360 7/1984 Kobayashi et al. ..... 123/352 X 4,541,379 9/1985 Ruschek et al. ..... 123/339

FOREIGN PATENT DOCUMENTS 83645 5/1982 Japan ..... 123/339

183842 10/1983 Japan ..... 123/339

2134288 8/1984 United Kingdom ..... 123/339

*Primary Examiner*—Tony M. Argenbright

*Attorney, Agent, or Firm*—Cushman, Darby & Cushman

[57] ABSTRACT

In an internal combustion engine having two bypass air passages for controlling the idling speed, one (first) of the bypass air passages is controlled in accordance with the engine speed, and the other (second) is controlled in accordance with the ON and OFF state of an electrical load such as an air conditioner. When the electrical load is in the ON state, the first bypass air passage is not closed. Also, before a predetermined time period passes after the electrical load is changed from the ON state to the OFF state, the first bypass air passage is not closed.

8 Claims, 9 Drawing Figures

1
2
3
4
5
5a
6
6a
7
8
9

APPARATUS FOR CONTROLLING IDLING SPEED IN INTERNAL COMBUSTION ENGINE HAVING TWO BYPASS AIR PASSAGES

BACKGROUND OF THE INVENTION (1) Field of the Invention

The present invention relates to an apparatus for controlling the idling speed in an internal combustion engine, the apparatus having two air passages bypassing a throttle valve disposed within an intake air passage.

(2) Description of the Related Art

In an internal combustion engine, in order to control the idling (engine) speed, a first bypass air passage bypassing a throttle valve is provided. The first bypass air passage is controlled in accordance with the engine speed. That is, when the engine speed exceeds the upper limit of a predetermined range, the first bypass air passage is closed, and when the engine speed becomes lower than the limit of a predetermined range, the first bypass air passage is opened, thus stabilizing the idling speed.

In the above-mentioned engine, when an electrical load such as an air conditioner or a power steering system is turned ON, the idling speed is usually not high enough to allow a generator (alternator) to provide the battery with a full replacement charge, thus draining the battery-charge. Further, when a vehicle has an automatic transmission and the gear position is changed from neutral (N) to drive (D) the idling speed may be reduced by the load placed on the engine. To avoid these disadvantages, a second bypass air passage bypassing the throttle valve is provided to further enhance the idling speed.

In the above-mentioned engine having two bypass air passages, however, when both of the bypass air passages are opened sometimes the engine speed increases to close the first bypass air passage, and immediately thereafter, the electrical load is turned OFF to close the second bypass air passage. In this case, the engine speed may be remarkably reduced, thus inviting engine stalling at worst.

Further, when the electrical load such as the air conditioner is turned OFF, the solenoid switch thereof is immediately turned OFF, however, there is a delay in closing the second bypass air passage. Therefore, even when the engine speed is slightly lower than the upper limit of the predetermined range, and in addition, the electrical load is turned OFF, the engine speed increases due to the delay in the closing of the second bypass air passage, so that the engine speed exceeds the upper limit of the predetermined range. As a result, the first bypass air passage is closed and undershoot of the engine speed occurs, also inviting engine stalling at worst.

SUMMARY OF THE INVENTION

It is an object of the present invention to provide an apparatus for controlling the idling speed in an internal combustion engine having two bypass air passages in which undershoot of the engine speed due to the turning OFF of the electrical load (or change of the gear-shift position from Drive to Neutral) is avoided, and accordingly, engine stalling is avoided.

According to the present invention, when the electrical load is in an ON state, the first bypass air passage is not closed. Also, before a predetermined time period passes after the electrical load is changed from the ON state to the OFF state, the first bypass air passage is not closed. Similarly, when the gear-shift position of the automatic transmission is at Drive the first bypass air passage is not closed. Also, before a predetermined time period passes after the gear-shift position is changed from Drive to Neutral, the first bypass air passage is not closed.

Thus, no closing of the first bypass air passage occurs for a predetermined time period after the second bypass air passage is closed. That is, the closing of the first bypass air passage immediately after the closing of the second bypass air passage is inhibited thereby avoiding undershoot of the engine speed.

BRIEF DESCRIPTION OF THE DRAWINGS

The present invention will be more clearly understood from the description set forth below with reference to the accompanying drawings, wherein.

DESCRIPTION OF THE PREFERRED EMBODIMENTS

Figures 1, 1A, 1B:
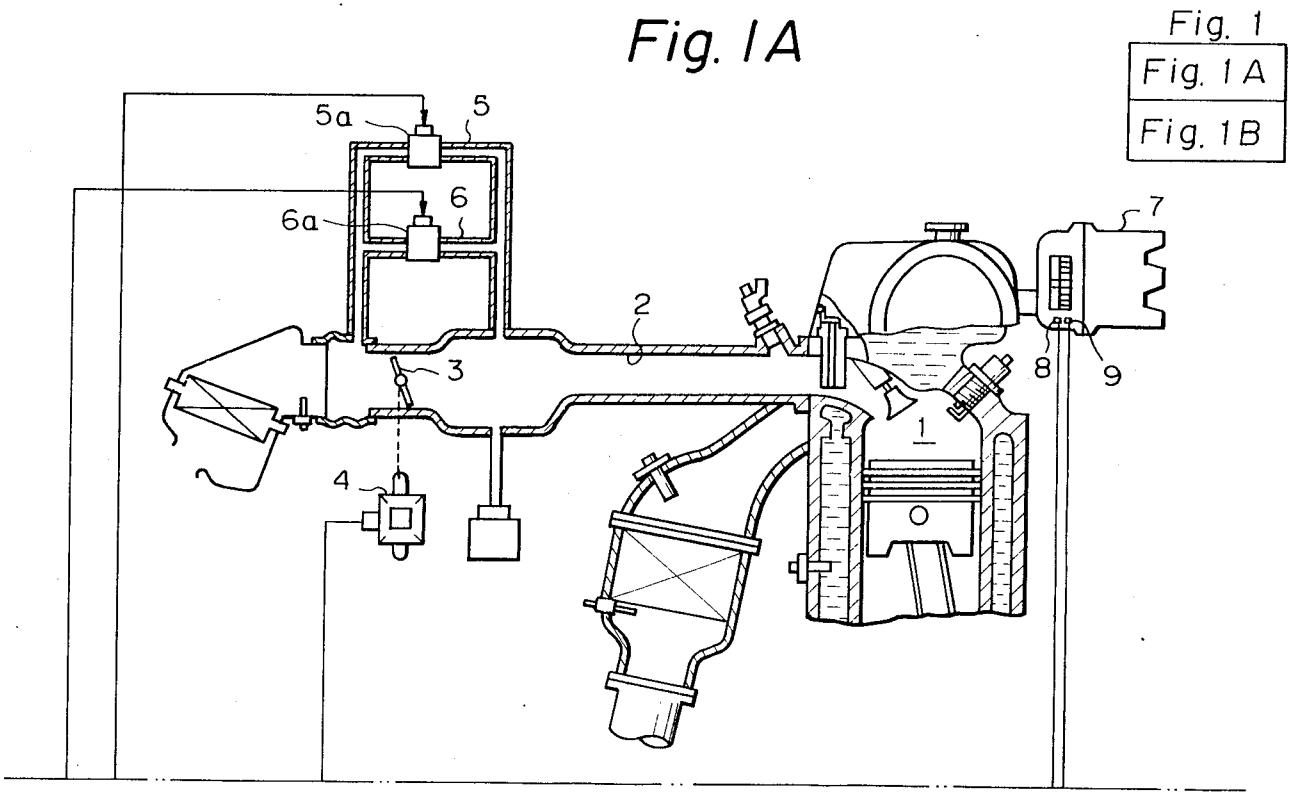
FIGS. 1, 1A an 1B are a schematic diagram of an internal combustion engine according to the present invention.
Figure 1B:
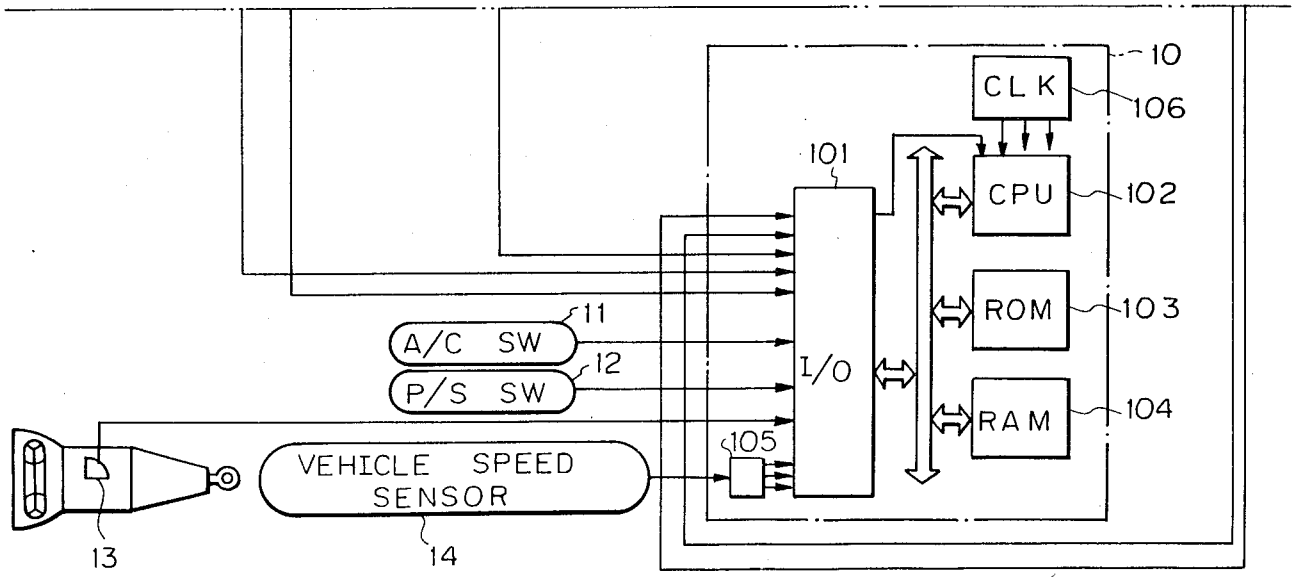

In FIG. 1, which illustrates an internal combustion engine according to the present invention, reference numeral 1 designates a four-cycle spark ignition engine disposed in an automotive vehicle. Provided in a throttle valve 3 of an intake air passage 2 is an idle switch 4 for detecting whether or not the throttle valve 3 is completely closed. The output of the idle switch 4 is supplied to an input/output (I/O) interface 101 of a control circuit 10.

Two bypass air passages 5 and 6 link points in the air intake passage 2 upstream and downstream of the throttle valve 3, thus bypassing the throttle valve 3. Each of the bypass air passages 5 and 6 serves as an idling-up mechanism. The cross-sections of the bypass air passages 5 and 6 are controlled by air flow rate control valves **5*a* and 6*a*, which are controlled by the control circuit 10. In this case, the air flow rate control valve 5*a* is conventionally comprised of a vacuum control valve (VCV), and the air flow rate control valve 6*a*** is conventionally comprised of an air control valve (ACV).

Disposed in a distributor 7 are crank angle sensors 8 and 9 for detecting the angle of the crankshaft (not shown) of the engine 1. In this case, the crank angle sensor 8 generates a pulse signal at every 720° crank angle (CA) while the crank angle sensor 9 generates a pulse signal at every 30° CA. The pulse signals of the crank angle sensors 8 and 9 are supplied to the I/O interface 101 of the control circuit 10. In addition, the pulse signal of the crank angle sensor 9 is supplied to an interruption terminal of a central processing unit (CPU) 102.

Reference numeral 11 designates an air conditioner switch which is turned ON and OFF, when the air conditioner (not shown) is turned ON and OFF, respectively. Reference numeral 12 designates a power steering switch which is turned ON and OFF when the power steering system (not shown) is turned ON and OFF, respectively. Reference numeral 13 designates a gear-shift position switch which is turned ON when the gear-shift position of the automatic transmission is at the Drive position.

Reference numeral 14 designates a vehicle speed sensor formed by a lead switch and a permanent magnet. The vehicle speed sensor 14 generates an output signal having a frequency reversely proportional to the vehicle speed SPD, and transmits that signal via a vehicle forming circuit 105 to the I/O interface 101.

The control circuit 10, which may be constructed by a microcomputer, further includes a read-only memory (ROM) 103 for storing a main routine, interrupt routines, tables (maps), constants, etc., a random access memory 104 (RAM) for storing temporary data, a clock generator 106 for generating various clock signals, and the like.

Interruptions occur at the CPU 102, when the crank angle sensor 9 generates a pulse signal, and when the clock generator 106 generates a special clock signal. The engine speed $N_e$ is calculated by an interrupt routine executed at 30° CA, i.e., at every pulse signal of the crank angle sensor 9, and is then stored in the RAM 104.

The operation of the control circuit 10 of FIG. 1 will be explained with reference to FIGS. 2 through 6.

Figure 2:
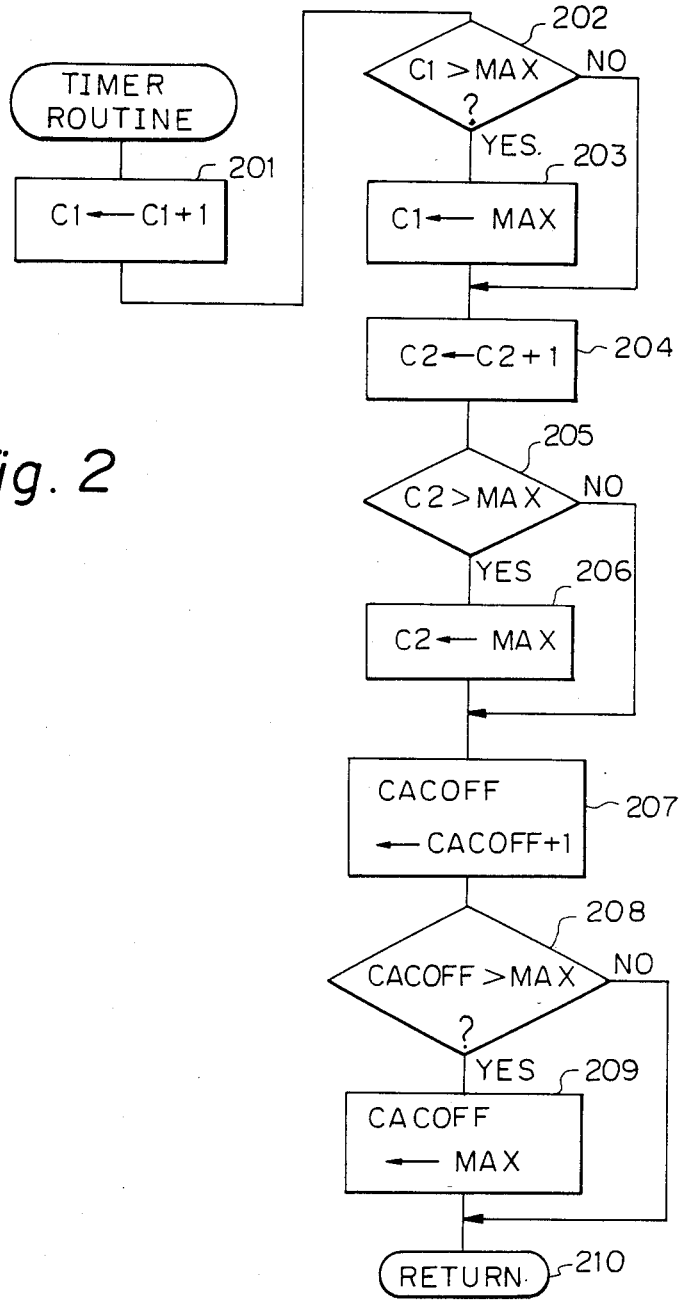
FIGS. 2 to 6 are flow charts showing the operation of the control circuit of FIG. 1.

FIG. 2 is a timer routine executed at every predetermined time period such as 32 ms. Here, a counter C1 is used for controlling the turning OFF (closing) of the VSV 5*a*, while a counter C2 is used for controlling the turning ON (opening) of the VSV 5*a*. Also, a counter CACOFF is used for measuring a time period after the air conditioner switch 11 is turned OFF. At step 201, the counter C1 is increased by 1, and at step 202, the valve of the counter C1 is compared with a maximum value MAX which is, for example, 255. If C1>MAX, the control proceeds to step 203 in which MAX is set in the counter C1. That is, the counter C1 is held at the value MAX. At step 204, the counter C2 is increased by 1, and at step 205, the value of the counter C2 is compared with the maximum value MAX. If C2>MAX, the control proceeds to step 206 in which MAX is set in the counter C2. That is, the counter C2 is held at the value MAX. At step 207, the counter CACOFF is increased by 1, and at step 208, the value of the counter CACOFF is compared with the maximum value MAX. If CACOFF>MAX, the control proceeds to step 209, in which MAX is set in the counter CACOFF. That is, the counter CACOFF is held at the value MAX.

The routine of FIG. 2 is completed by step 210.

Thus, the routine of FIG. 2 increments the counters C1, C2, and CACOFF by 1.

Figure 3:
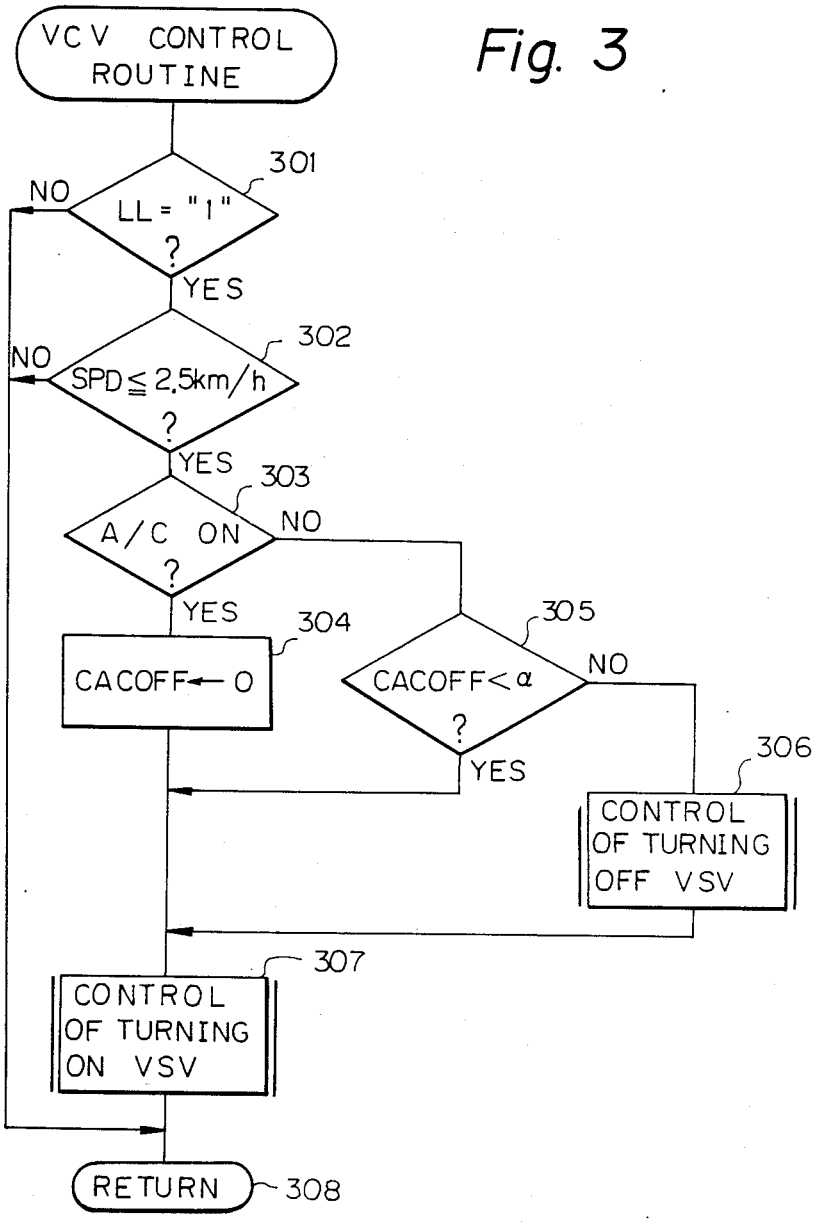

FIG. 3 is a routine for controlling the turning ON and OFF of the VCV 5*a* executed at every predetermined time period, such as 32 ms. At step 301, it is determined whether or not the output LL of the idle switch 4 is "1", i.e., the throttle valve 4 is completely closed. At step 302, it is determined whether (or not) the vehicle speed SPD is smaller than or equal to 2.5 km/h. That is, the flow at steps 301 and 302 determines whether or not the engine is in an idling state. Only when the engine is in an idling state, does the control proceed to step 303. Otherwise, the control jumps to step 308.

At step 303, it is determined whether or not the air conditioner switch 11 is in an ON state. When the air conditioner switch 11 is in an ON state, the control proceeds to step 304 which clears the counter CACOFF, and further proceeds to step 307 which controls the turning ON of the VSV 5*a* without controlling the turning OFF of the VSV 5*a*. The step 307 will be later explained with reference to FIG. 5.

When the air conditioner switch 11 is turned OFF, the flow from step 303 to step 304 is switched to the flow from step 303 to step 305. As a result, the counter CACOFF substantially counts up by the routine of FIG. 2. In this state, since CACOFF$<\alpha$, then the control also proceeds to step 307. Note that $\alpha$ is, for example, 125 (about 4*s*).

Figure 4:
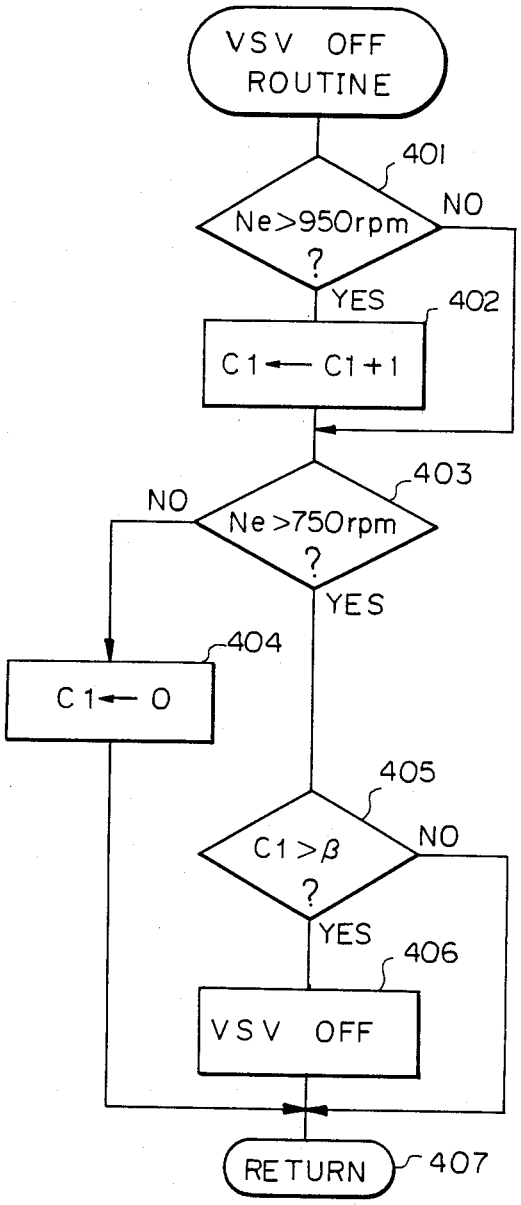

When the air conditioner switch 11 remains in the OFF state, the counter CACOFF satisfies CACOFF$\geqq\alpha$, then the flow from step 305 to step 307 is switched to the flow from step 305 to the step 306 which controls the turning OFF of the VSV 5*a*, which step 306 will be later explained with reference to FIG. 4.

The routine of FIG. 3 is completed by step 308.

Thus, when the air conditioner switch 11 is in an ON state, or before a predetermined time period ($=\alpha\times 32$ ms) passes after the air conditioner switch 11 is changed from the ON state to the OFF state, control of turning OFF the VSV 5*a* is prohibited.

The VSV turning OFF step 306 of FIG. 3 will be explained with reference to FIG. 4. At step 401, the engine speed data $N_e$ is read out of the RAM 104, and it is determined whether or not $N_e>950$ rpm is satisfied. Only when $N_e>950$ rpm, does the control proceed to step 402 which increments the counter C1 by 1. Otherwise, the control jumps to step 403.

At step 403, it is determined whether or not $N_e>750$ rpm is satisfied. If $N_e\leqq 750$ rpm, the control proceeds to step 404 which clears the counter C1, and jumps to step 407.

Thus, if $N_e\leqq 750$ rpm, the counter C1 is cleared. If 750 rpm$\leqq N_e\leqq 950$ rpm, the counter C1 is counted up by 1 at every 32 ms due to the step 201 of FIG. 2. If $N_e>950$ rpm, the counter C1 is counted up by 2 at every 32 ms due to the step 201 of FIG. 2 and the step 402 of FIG. 4.

As a result, when the counter C1 satisfies C1$>\beta$, the flow from step 405 to step 407 is switched to the flow from step 405 to step 406 which turns OFF the VSV 5*a*. Note that $\beta$ is, for example, 20 to 30.

Figure 5:
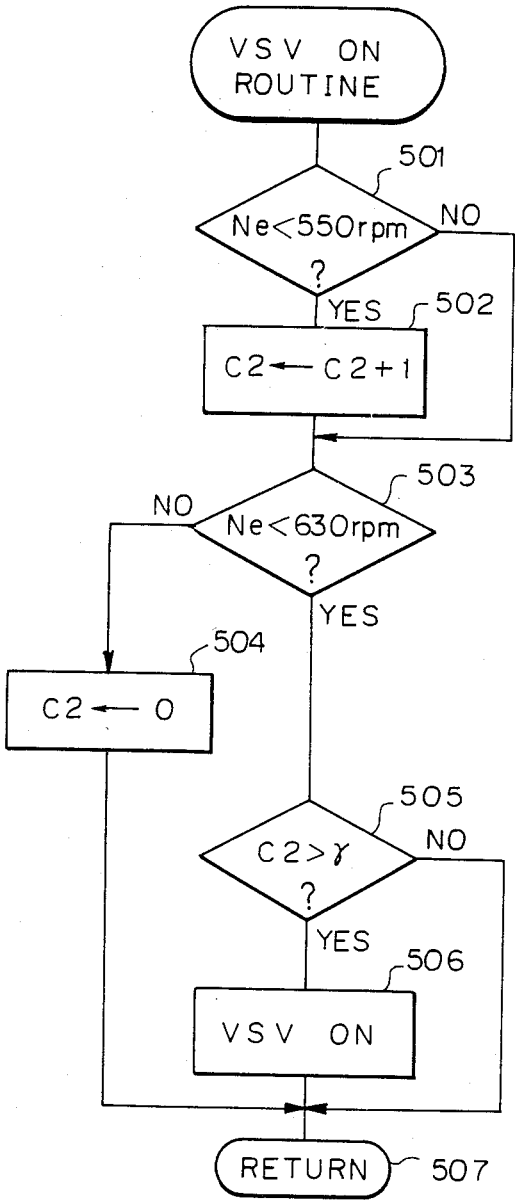

The VSV turning ON step 307 of FIG. 3 will be explained with reference to FIG. 5. At step 501, the engine speed data $N_e$ is read out of the RAM 104, and it is determined whether or not $N_e<550$ rpm is satisfied. Only when $N_e$21 550 rpm, does the control proceed to step 502 which increments the counter C2 by 1. Otherwise, the control jumps to step 503.

At step 503, it s determined whether or not $N_e<630$ rpm is satisfied. If $N_e\geqq 630$ rpm, the control proceeds to step 504 which clears the counter C2, and jumps to step 507.

Thus, if $N_e\geqq 630$ rpm, the counter C2 is cleared. If 550 rpm$\leqq$Ne$<$630 rpm, the counter C2 is counted up by 1 at every 32 ms due to the step 204 of FIG. 2. If $N_e<550$ rpm, the counter C2 is counted up by 2 at every 32 ms due to the step 204 of FIG. 2 and the step 502 of FIG. 5.

As a result, when the counter 2 satisfies C2$>\gamma$, the flow from step 505 to step 507 is switched to the flow from step 505 to step 506 which turns ON the VSV 5*a*. Note that $\gamma$ is, for example, 12 to 20.

Thus, only when the engine speed $N_e$ is outside on a predetermined range (such as 630 rpm$\leqq N_e\leqq$750 rpm), is the VSV 5*a* controlled. When the engine speed $N_e$ is within the predetermined range, the VSV 5*a* remains at the previous state.

Figure 6:
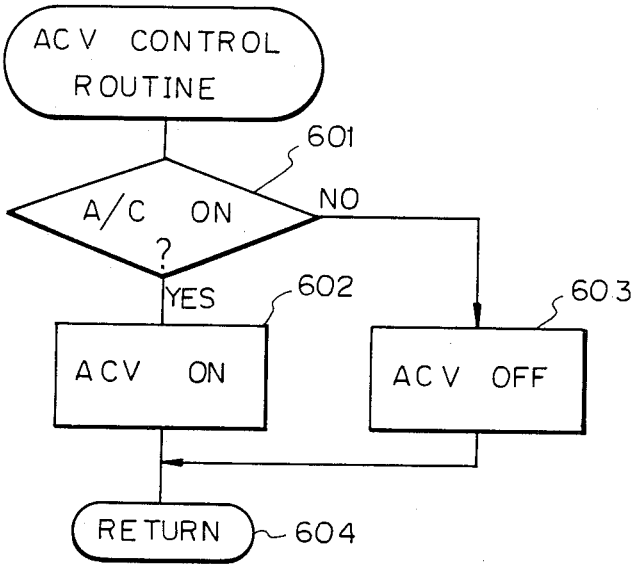

FIG. 6 is a routine for controlling the ACV 6*a* executed at every predetermined time period such as 32 ms. At step 601, it is determined whether the air conditioner switch 11 is in an ON state or in an OFF state. When the air conditioner switch 11 is in the ON state, the control proceeds to step 602 which turns ON the ACV 6*a*, and when the air conditioner switch 11 is in the OFF state, the control proceeds to step 603 which turns OFF the ACV 6*a*. Then, the routine of FIG. 6 is completed by step 604.

Note that values other than 950 rpm, 750 rpm, 630 rpm, and 550 rpm can be used as occasion demands. In addition, at step 303 of FIG. 3 and at step 601 of FIG. 6, instead of the determination of the air conditioner switch 11, it can be determined whether or not the power steering switch 12 is in an ON state, or it can be determined whether the gear-shift position switch 13 of the automatic transmission is at the drive position or at the neutral position. Further, all three determinations can be carried out. In this case, if at least one of the determinations is affirmative, the control proceeds to step 304 (or step 602), but if all of the determinations are negative, the control proceeds to step 305 (or step 603).

Figure 7:
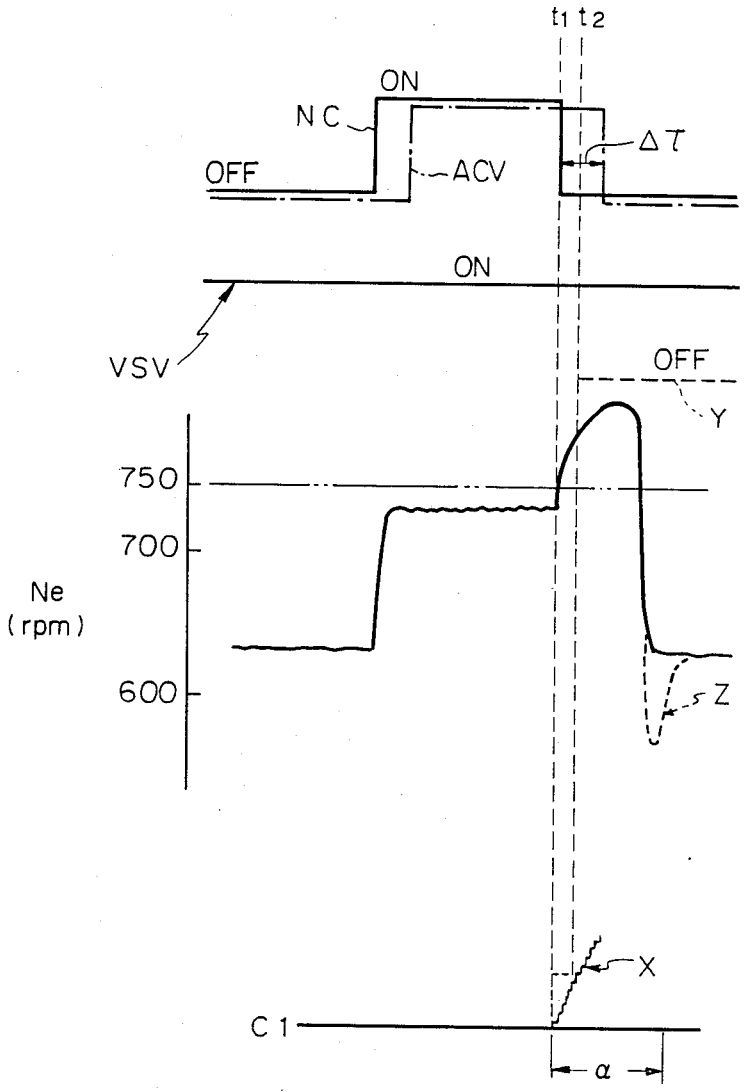
FIG. 7 is a timing diagram showing the effect according to the present invention.

In FIG. 7, which is a timing diagram showing the effect according to the present invention, at time $t_1$, when the air conditioner (A/C) switch 11 is changed from the ON state to the OFF state, the ACV 6*a* is turned OFF with a delay $\Delta\tau$. As a result, the engine speed $N_e$ is increased and exceeds the upper limit (for example, 750 rpm) of a predetermined range. In this case, according to the present invention, the VCV 5*a* is not turned OFF, thus stabilizing the idling speed, since the counter C1 remains at O for a predetermined time period $\alpha$ after time $t_1$.

In the prior art, however, the counter C1 is incremented as indicated by X after time $t_1$. As a result, at time $t_2$, the VSV 5*a* is turned OFF as indicated by Y, which invites undershoot of the engine speed $N_e$ as indicated by Z.

As explained above, according to the present invention, undershoot of the engine speed $N_e$ can be avoided, and accordingly, engine stalling also can be avoided.

What is claimed is:

1. An apparatus for controlling the idling speed in an internal combustion engine, comprising:

an intake air passage;

a throttle valve, positioned within said intake air passage, for adjusting the amount of intake air flowing through said intake air passage;

first and second bypass air passages, linked to said intake air passage at points upstream and downstream of said throttle valve, thus bypassing said throttle valve;

a first means for determining whether or not the engine speed is larger than a first value;

a second means for determining whether or not the engine speed is smaller than a second value, said second value being smaller than said first value;

means for closing said first bypass air passage when the engine speed is larger than said first value;

means for opening said first bypass air passage when the engine speed is smaller than said second value;

means for determining whether an electrical load is in an ON state or in an OFF state;

means for opening and closing said second bypass air passage in accordance with the determination of whether said electrical load is in the ON and OFF state, respectively;

a timer means for measuring a predetermined time period after said electrical load is changed from the ON state to the OFF state;

means for inhibiting the operation of said bypass air passage closing means when said electrical load is in the ON state, or when said timer means measures said predetermined time period.

2. An apparatus as set forth in claim 1, wherein said bypass air passage closing means closes said first bypass air passage with a first delay time period; and wherein said bypass air passage opening means opens said first bypass air passage with a second delay time period.

3. An apparatus as set forth in claim 2, further comprising a third means for determining whether or not the engine speed is larger than a third value, said third value being larger than said first value;

a fourth means for determining whether or not the engine speed is smaller than a fourth value, said fourth value being smaller than said second value;

said bypass air passage closing means closing said first bypass air passage with a third delay time period smaller than said first delay time period when the engine speed is larger than said third value; and said bypass air passage opening means opening said first bypass air passage with a fourth delay time period smaller than said second delay time period when the engine speed is smaller than said fourth value.

4. An apparatus as set forth in claim 1, wherein said electrical load is an air conditioner.

5. An apparatus as set forth in claim 1, wherein said electrical load is a power steering system.

6. An apparatus for controlling the idling speed in an internal combustion engine mounted on an automatic transmission vehicle, comprising:

an intake air passage;

a throttle valve, positioned within said intake air passage, for adjusting the amount of intake air flowing through said intake air passage;

first and second bypass air passages, linked to said intake air passage at points upstream and downstream of said throttle value, thus bypassing said throttle valve;

a first means for determining whether or not the engine speed is larger than a first value;

a second means for determining whether or not the engine speed is smaller than a second value, said second value being smaller the said first value;

means for closing said first bypass air passage when the engine speed is larger than said first value;

means for opening said first bypass air passage when the engine speed is smaller than said second value;

means for determining whether the gearshift position of the automatic transmission is at a drive (D) position or at a neutral position;

means for opening and closing said second bypass air passage in accordance with the determination of whether the gear-shift position is at the drive position or at the neutral position;

a timer means for measuring a predetermined time period after the gear-shift position is changed from the drive position to the neutral position; and means for inhibiting the operation of said bypass air passage closing means when the gear-shift position is at the drive position, or when said timer means measures said predetermined time period.

7. An apparatus as set forth in claim 6, wherein said bypass air passage closing means closes said first bypass air passage with a first delay time period; and wherein said bypass air passage opening means opens said first bypass air passage with a second delay time period.

8. An apparatus as set forth in claim 7, further comprising a third means for determining whether or not the engine speed is larger than a third value, said third value being larger than said first value;

a fourth means for determining whether or not the engine speed is smaller than a fourth value, said fourth value being smaller than said second value;

said bypass air passage closing means closing said first bypass air passage with a third delay time period smaller than said first delay time period when the engine speed is larger than said third value; and said bypass air passage opening means opening said first bypass air passage with a fourth delay time period smaller than said second delay time period when the engine speed is smaller than said fourth value.

* * * * *